United States Patent [19]

Rumpler

[11] 4,193,402

[45] Mar. 18, 1980

[54] BOTTLE STOPPER AND METHOD OF USING SAID STOPPER

[76] Inventor: Jean-Jacques Rumpler, 1 Allee Marie-Louis, Montsoult, France, 95360

[21] Appl. No.: 8,885

[22] Filed: Feb. 2, 1979

[30] Foreign Application Priority Data

Feb. 8, 1978 [FR] France ..... 78 03554

[51] Int. Cl.[2] ..... B65D 51/16

[52] U.S. Cl. ..... 128/272; 34/5; 215/307; 215/247

[58] Field of Search ..... 34/5; 215/247, 307; 128/272

[56] References Cited

U.S. PATENT DOCUMENTS

| | | | |
|---|---|---|---|
| 2,647,513 | 8/1953 | Holmes | 128/272 |
| 3,708,886 | 1/1973 | Ogle | 34/5 |
| 3,881,626 | 5/1975 | Bartell | 215/307 X |
| 3,901,402 | 8/1975 | Ayres | 215/307 X |
| 4,060,911 | 12/1977 | Weiler et al. | 34/5 |

*Primary Examiner*—Donald F. Norton

*Attorney, Agent, or Firm*—Sandler & Greenblum

[57] ABSTRACT

A bottle stopper comprising a cap and a skirt portion extending from the cap. The skirt member comprises: a flange arranged on the skirt member; a first slit extending from the lower end of the skirt, which is spaced from the cap, to a point on the skirt between the lower end and the cap; and a second slit extending from the lower end of the skirt to a point on the skirt between the flange and the lower end of the skirt. The second slit is bordered by first and second edges, each comprising a protuberance.

A method of packaging a pharmaceutical substance comprising the steps of: filling a bottle with the pharmaceutical substance; inserting the inventive bottle stopper into the top of the bottle.

13 Claims, 5 Drawing Figures

BOTTLE STOPPER AND METHOD OF USING SAID STOPPER

BACKGROUND OF THE INVENTION

1. Field of the Invention

The invention relates to a stopper which may be used for bottles containing pharmaceutical products, particularly products intended to be subjected to a lyophilization treatment.

2. Description of the Prior Art

Various conventional stoppers are known which comprise an upper portion connected to a skirt-like member adapted to extend into the neck of a bottle up to a shoulder on the stopper. The skirts comprise a lateral opening extending from a point intermediate their length up to as far as the free end of the skirt. The stoppers additionally comprise a peripheral flange.

With stoppers of this type, in the course of treatment of a pharmaceutical product contained within the vial or bottle, the stopper is inserted within the bottle as far as the flange on the stopper such that the interior of the bottle is exposed to the atmosphere through lateral openings in the stoppers. Once the treatment of the substance within the bottle has been completed, the stopper is forced into the bottle up to the shoulder of the stopper such that the upper rim of the neck of the bottle is covered by a protective cap. When the product within the bottle is to be used, the stopper is pierced by means of a hollow needle and a liquid substance or product is injected into the bottle. The resulting mixture is drawn out of the bottle by means of suction into a syringe through a hollow needle.

Such stoppers suffer from the inconvenience that when the bottles with which they are used are small vials or the like, the substance within the bottle or vial, e.g., medication or the like, will be present in only very small quantities. In such a case, the lower end of the skirt of the stopper forms a sort of baffle when the syringe is being filled and acts to retain a portion of the product which is thus lost.

Other known stoppers avoid the above problem in that they are provided with a skirt member having a diametrical slot which extends up to the shoulder of the upper portion of the stopper. However, such stoppers are difficult to use during the stage in which the medicinal product or the like is treated within the bottle. This results since various treatment steps are performed on the bottles by means of automatic machines and the bottles are necessarily subjected to vibration. Since the stoppers are barely held within the bottles, there is a danger of them falling off prematurely which is the case with stoppers having a diametrical slot. With such stoppers, since the skirt member is in effect cut in two, it no longer exhibits the resistance necessary to maintain the stopper in the bottle neck unless it is completely inserted in the bottle.

SUMMARY OF THE INVENTION

It is, therefore, an object of the invention to provide a stopper which overcomes each of the above disadvantages.

It is a further object of the invention to provide a stopper which is effectively held within the necks of bottles or vials while substances within the containers are treated by subjecting them to a treatment atmosphere and which, nevertheless, serve to securely close the containers once the treatment step or steps have been completed and a stopper is completely inserted in the bottle neck.

These and other objects are fulfilled by means of the bottle stopper of the invention which comprises a cap and a skirt portion extending from the cap. The skirt portion is adapted to be received in a neck portion of a bottle. The skirt member comprises a flange arranged on the skirt member and a first slit extending from the lower end of the skirt and spaced from the cap. The slit extends to a point on the skirt between the lower end of the skirt and the cap. The stopper further comprises a second slit extending from the lower end of the skirt to a point on the skirt between the flange and the lower end of the skirt. The second slit is ordered by first and second edges each of which comprises a protuberance. Each of the protuberances is adapted to abut the other and to space each of the first and second edges when the stopper is inserted in a bottle such that the skirt is inserted within the bottle to a level below the flange.

The above objects are further fulfilled by means of the method of the invention which comprises a method of packaging a pharmaceutical substance comprising the steps of: filling a bottle with the pharmaceutical substance; inserting a bottle stopper comprising a cap and a skirt, the skirt member comprising: a flange arranged on the skirt member; a first slit extending from the lower end of the skirt, which is spaced from the cap, to a point on the skirt between the lower end and the cap; and a second slit extending from the lower end of the skirt to a point on the skirt between the flange and the lower end; the second slit being bordered by first and second edges, each of the first and second edges comprising a protuberance, each of the protuberances being adapted to abut one another and space each of the first and second edges when the stopper is inserted in a bottle such that the skirt is inserted within the bottle to a level below the flange, such that the first slit is at least partially open to ambient conditions; lyophilizing the pharmaceutical substance; and fully inserting the stopper within the bottle to seal the interior of the bottle.

BRIEF DESCRIPTION OF DRAWINGS

With reference to the annexed drawings, illustrating the invention by way of example.

DESCRIPTION OF PREFERRED EMBODIMENTS

The stopper according to the invention comprises a skirt member adapted, by means of elastic deformation, to be inserted within the neck of a bottle. An upper portion or cap of the stopper is connected to the skirt by means of a shoulder. The skirt comprises a peripheral collar or flange located at a point along its length which engages within the bottle neck when the product within the bottle is being treated. The stopper further comprises a lateral opening or slit extending from the lower or free end of the skirt to a point along the skirt between the collar or flange and the cap. The skirt member of the stopper comprises a slot extending from the lower edge of the skirt to a point on the skirt located between the flange and the lower edge. A lip or edge is formed on each side of the slot and comprises a protuberance on its face facing the other edge. The protuberances are shaped such that when the skirt of the stopper is introduced into a bottle neck the protuberances are abutted against one another and tend to space the edges from one another.

As a result of the structure of the stopper, when the liquid mixture within the bottle is drawn off into a syringe, all of the liquid product may be recovered. Additionally, when the product within the bottle is being pre-treated, the stopper is only partially engaged within the bottle neck but nevertheless perfectly maintains its position without the danger of it being prematurely removed.

In accordance with one embodiment of the invention the protuberances are hemispherical. As a result, there is no danger of the product within the bottle being drawn off being impeded or blocked.

Preferably, the skirt member additionally comprises a second flange or collar close to its lower end. This flange improves the grip of the stopper within the bottle neck when the stopper is partially inserted within the bottle neck during the pre-treatment step or steps.

Figure 1:
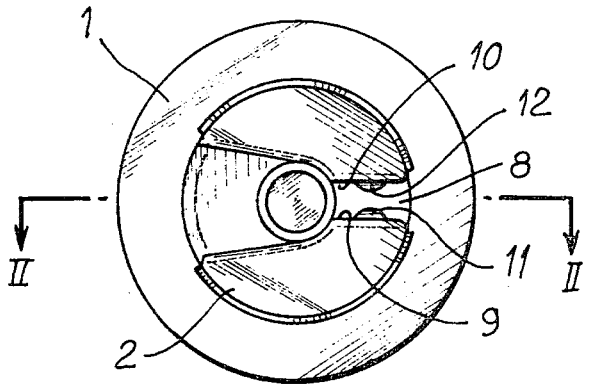
FIG. 1 illustrates a bottom planar view of a stopper according to the invention.
Figure 2:
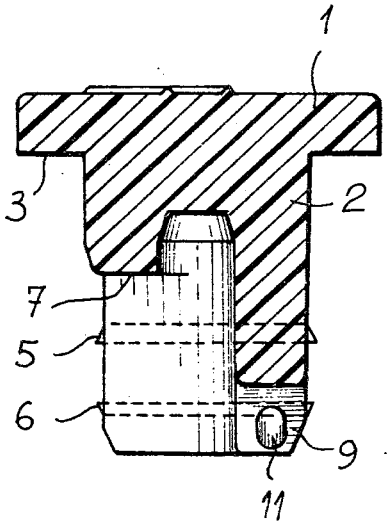
FIG. 2 is a cross-sectional view of the stopper along line II—II shown in FIG. 1.
Figure 3:
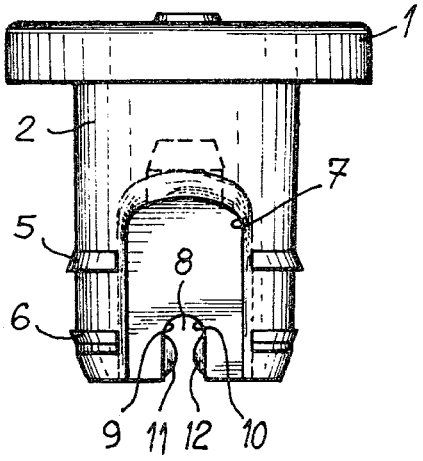
FIG. 3 is an elevational view of the stopper according to the invention.

Turning to FIGS. 1–3, it may be seen that the stopper comprises an upper portion or cap 1, in the general shape of a cylindrical disk as well as a skirt 2 connected to the cap at a shoulder 3.

Skirt 2 comprises two preferably parallel peripheral flanges or collars 5 and 6. The flanges are preferably arranged perpendicular to the longitudinal axis of the skirt 2.

Skirt 2 comprises an opening 7 which extends from the lower end of the skirt up to a point on the skirt located between first flange 5 and cap 3. Skirt 2 is additionally provided with a slot 8 which comprises two lips or edges 9 and 10. Protuberances or projections 11 and 12 are preferably of hemispherical cross-section.

Protuberances 11 and 12 are adapted such that when the stopper is inserted within the neck of the bottle, the protuberances are forced or abutted against one another and, as a result, tend to provide a certain rigidity to the skirt member which is not weakened by the slot 8.

Figure 4:
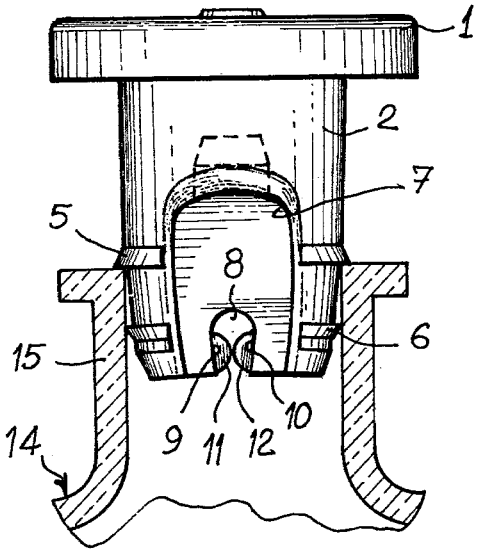
FIG. 4 illustrates the stopper partially inserted within the bottle neck.

FIG. 4 illustrates the stopper of the invention in a position corresponding to a treatment or pre-treatment of a pharmaceutical product or the like contained within a bottle 14. Such a treatment is generally of the lyophilization type although any other treatment or pre-treatment of the material within the bottle conventionally performed may likewise be performed with the stopper of the invention.

As is apparent from FIG. 4, the stopper is inserted in the neck 15 of the bottle 14 up to the lower edge of collar 5. By virtue of the opening 7, the bottle is not hermetically sealed and the interior of the bottle is thus in communication with atmospheric or ambient conditions. When in this position, edges 9 and 10 are forced against one another and protuberances 11 and 12 abut one another such that they serve to space the edges and thus assure that the stoppers are securely held within the neck.

Figure 5:
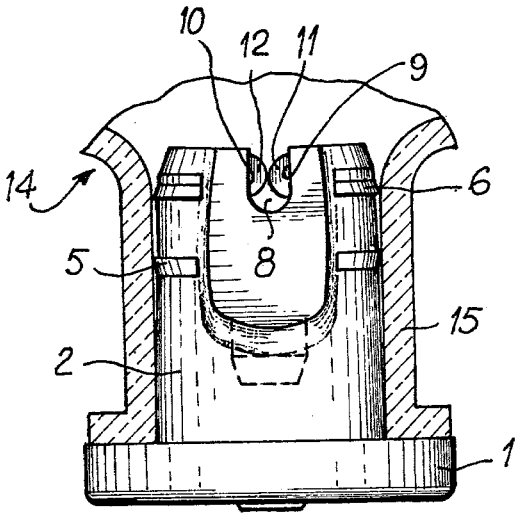
FIG. 5 illustrates the stopper completely inserted within the bottle neck, when the product is to be withdrawn.

FIG. 5 illustrates the stopper of the invention in the position which it occupies when the medicinal product or the like is removed by means of a hollow needle and syringe.

A hollow needle, such as a hypodermic needle, passes through the stopper so that its open end extends into the central cavity defined by the skirt member 2. The medicinal product is thus free to flow towards the central cavity through slots 7 and 8. It is to be noted that only a very small quantity of product is retained by means of the lower edge of the skirt.

First and second flanges, 5 and 6, may preferably have the shape shown in the drawings although other suitable shapes and designs are likewise possible. Furthermore, the flanges may be continuous, as shown, or in the alternative, discontinuous.

The stopper may be made of any of the materials normally used in conjunction with bottles or vials providing that the stopper is capable of exhibiting the flexibility necessary for purposes of the invention.

Finally, while the stopper has been described in connection with and in combination with bottles and vials containing medicinal products it is to be understood that the invention is not limited to containers containing medicines and may be used in conjunction with other materials such as foods and the like. The stopper may likewise be used in conjunction with containers other than bottles and vials without departing from the scope of the invention.

Although the invention has been described with respect to particular embodiments and materials, it is to be understood that the invention is not limited except as defined by the claims.

What is claimed is:

1. A bottle stopper comprising a cap and a skirt portion extending from said cap and adapted to be received in a neck portion of a bottle, said skirt member comprising:

(a) a flange arranged on said skirt member;

(b) a first slit extending from the lower end of said skirt, which is spaced from said cap, to a point on said skirt between said lower end and said cap; and (c) a second slit extending from the lower end of said skirt to a point on said skirt between said flange and said lower end; said second slit being bordered by first and second edges, each of said first and second edges comprising a protuberance, each of said protuberances being adapted to abut one another and space each of said first and second edges when said stopper is inserted in a bottle such that said skirt is inserted within said bottle to a level below said flange.

2. The bottle stopper as defined by claim 1 wherein each of said protuberances are arranged opposite one another.

3. The bottle stopper as defined by claim 2 wherein said protuberances are hemispherical.

4. The bottle stopper as defined by claim 3 wherein said flange is arranged around the periphery of said skirt.

5. The bottle stopper as defined by claim 4 wherein said first slit extends to a point between said flange and said cap.

6. The bottle stopper as defined by claim 5 in combination with a bottle, said stopper being inserted within said bottle.

7. The combination as defined by claim 6 wherein said stopper is inserted within said bottle such that the upper portion of said first slit is exposed while said second slit is completely within said bottle.

8. The combination as defined by claim 6 wherein said first and second slits are completely within said bottle.

9. The combination as defined by claim 6 wherein said bottle contains a pharmaceutical substance.

10. The combination as defined by claim 9 wherein said pharmaceutical substance has been lyophilized.

11. The bottle stopper as defined by claim 1 wherein said protuberances are hemispherical.

12. The bottle stopper as defined by claim 1 wherein said flange is a first flange and said stopper comprises a second flange, said second flange being arranged between the lower end of said skirt and said first flange.

13. A method of packaging a pharmaceutical substance comprising the steps of:

(a) filling a bottle with said pharmaceutical substance;

(b) inserting a bottle stopper comprising a cap and a skirt, said skirt member comprising: a flange arranged on said skirt member; a first slit extending from the lower end of said skirt, which is spaced from said cap, to a point on said skirt between said lower end and said cap; and a second slit extending from the lower end of said skirt to a point on said skirt between said flange and said lower end; said second slit being bordered by first and second edges, each of said first and second edges comprising a protuberance, each of said protuberances being adapted to abut one another and space each of said first and second edges when said stopper is inserted in a bottle such that said skirt is inserted within said bottle to a level below said flange, such that said first slit is at least partially open to ambient conditions;

(c) lyophilizing said pharmaceutical substance; and (d) fully inserting said stopper within said bottle to seal the interior of said bottle.

* * * * *